US008545243B2

(12) United States Patent
Lin

(10) Patent No.: US 8,545,243 B2
(45) Date of Patent: Oct. 1, 2013

(54) LOCK STRUCTURE OF PLUG OF CABLE

(75) Inventor: Ping-Hsien Lin, Yuanlin Township, Zhanghua County (TW)

(73) Assignee: Lintex Co., Ltd., Zhanghua County (TW)

( * ) Notice: Subject to any disclaimer, the term of this patent is extended or adjusted under 35 U.S.C. 154(b) by 60 days.

(21) Appl. No.: 13/429,265

(22) Filed: Mar. 23, 2012

(65) Prior Publication Data

US 2012/0270429 A1 Oct. 25, 2012

(30) Foreign Application Priority Data

Apr. 21, 2011 (TW) ..... 100207077 U

(51) Int. Cl.
*H01R 13/44* (2006.01)

(52) U.S. Cl.
USPC ..... 439/133

(58) Field of Classification Search
USPC ..... 439/304, 133, 142, 352, 344, 309, 439/138, 676, 357
See application file for complete search history.

(56) References Cited

U.S. PATENT DOCUMENTS

| | | | | |
|---|---|---|---|---|
| 4,846,708 | A * | 7/1989 | Marson et al. | 439/133 |
| 5,090,916 | A * | 2/1992 | Magnier | 439/352 |
| 5,305,380 | A * | 4/1994 | Hileman et al. | 379/445 |
| 5,340,324 | A * | 8/1994 | Fields et al. | 439/133 |
| 5,429,522 | A * | 7/1995 | Noschese et al. | 439/133 |
| 5,556,295 | A * | 9/1996 | McFadden et al. | 439/301 |
| 7,204,721 | B2 * | 4/2007 | Lundholm et al. | 439/676 |
| 7,806,706 | B2 * | 10/2010 | Obenshain | 439/133 |
| 7,976,329 | B2 * | 7/2011 | Foung | 439/352 |
| 8,202,110 | B2 * | 6/2012 | Morrison et al. | 439/344 |
| 8,277,128 | B2 * | 10/2012 | Hackett | 385/58 |
| 2006/0025003 | A1 * | 2/2006 | Liao | 439/344 |
| 2009/0007609 | A1 * | 1/2009 | Obenshain | 70/158 |
| 2009/0047818 | A1 * | 2/2009 | Irwin et al. | 439/304 |

* cited by examiner

*Primary Examiner* — Alexander Gilman

(57) ABSTRACT

The present invention provides a lock structure of plug of cable including a main body and a key. The main body has a locking area, an elastic area with an elastic element, and a lower room which is able to receive a plug of cable. The elastic element tends to stay at a first position. When the key is not inserted into the locking area, the elastic element is at the first position, and a latch of the plug of the cable is unable to be compressed due to the fixation by the elastic element. When the key is inserted into the locking area and is rotated, the elastic element is pushed to a second position, and the latch is able to be compressed. Thereby, the lock structure of plug of cable can be used to control the availability of the plug for a jack.

8 Claims, 8 Drawing Sheets

LOCK STRUCTURE OF PLUG OF CABLE

BACKGROUND OF THE INVENTION

1. Field of the Invention

The present invention relates to a lock structure of plug of cable, more especially to a lock structure of plug of cable with multiple locking mechanisms.

2. Description of the Prior Art

Network is widely used for information communication nowadays, such as communication of internal informations in a company. A plurality of informations which is important or confidential is saved in a network environment of a company. The information is available to be accessed by any personal computer or notebook computer via network. Thus, an unauthorized user can easily acquire datas and informations by replacing a cable which is initially connected to a jack by his own cable and computer, so the information is exposed to risk.

On the other hand, for an equipment used to be a network server, disconnection of cable may result huge loss. Thus, the connection of the cable of the equipment has to be ensured. However, conventional cables are available to be unplugged by anyone. If the cable is engaged in a jack irreversibly, it may become inconvenient in use. Thereby, how to secure the cable in a jack firmly to prevent from being unengaged but also to ensure the cable can be detached by only specific means by an authorized user becomes an imperative task.

The present invention, therefore, makes improvements on the disadvantages as mentioned above.

SUMMARY OF THE INVENTION

The main object of the present invention is to provide a lock structure of plug of cable to control the availability of a plug of cable for a jack.

To achieve the above and other objects, the lock structure of plug of cable includes a main body, an elastic element, and a key.

The main body has a first partition and a second partition to partition an internal space to an upper room and a lower room. The upper room includes an elastic area and a locking area. The first partition is located under the elastic area, and a key opening is formed on a wall of the locking area to receive a key and to enable the key to rotate in the locking area. The key and the key opening have corresponding shape so that only the key is able to be inserted into the key opening and to rotate in the locking area. The lower room is able to receive a plug of cable, wherein the plug of cable is inserted into the lower room via a side of the main body having the key opening. Also, the plug has a compressible latch.

The elastic element is located in the elastic area. The elastic element is able to move between a first position and a second position and tends to stay at the first position. When the elastic element is at the first position, the latch of the plug is unable to be compressed due to fixation by a fixing hole of the elastic element. When the elastic element is at the second position, the fixing hole is dissociated from the latch to enable the latch to be compressed.

To sum up, when the key is not inserted into the key opening and is not rotated, the elastic element stays at the first position and the latch is unable to be compressed. Hence, the plug can not be detached from a jack. When the key is inserted into the key opening and is rotated toward a specific direction, the elastic element is pushed to the second position by the key, and the latch of the plug is compressed by the key. Hence, the plug can be detached from a jack.

Thereby, the lock structure of plug of cable provides easy controlling of the availability of the plug of cable for a jack.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
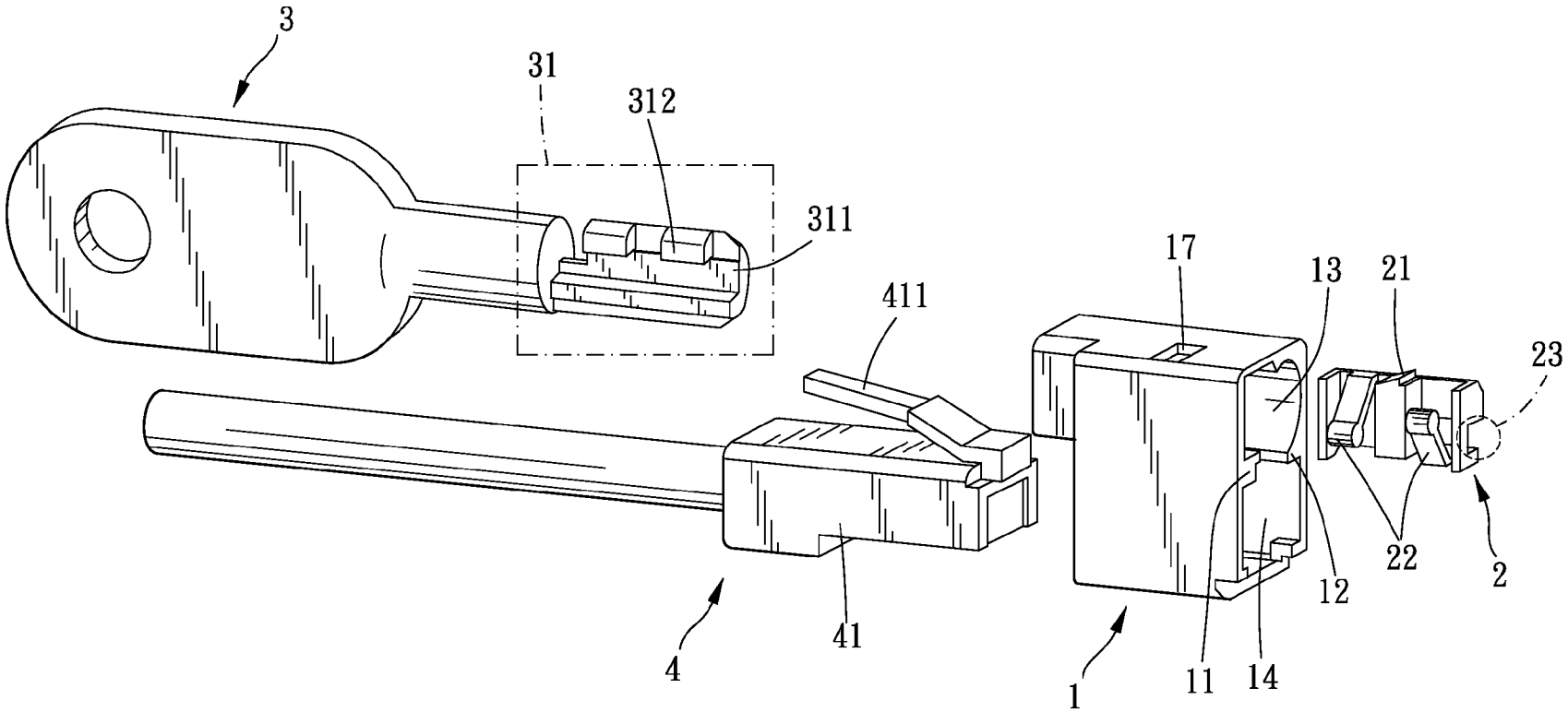
FIG. 1 is a breakdown view showing a lock structure of plug of cable of the present invention.
Figure 2:
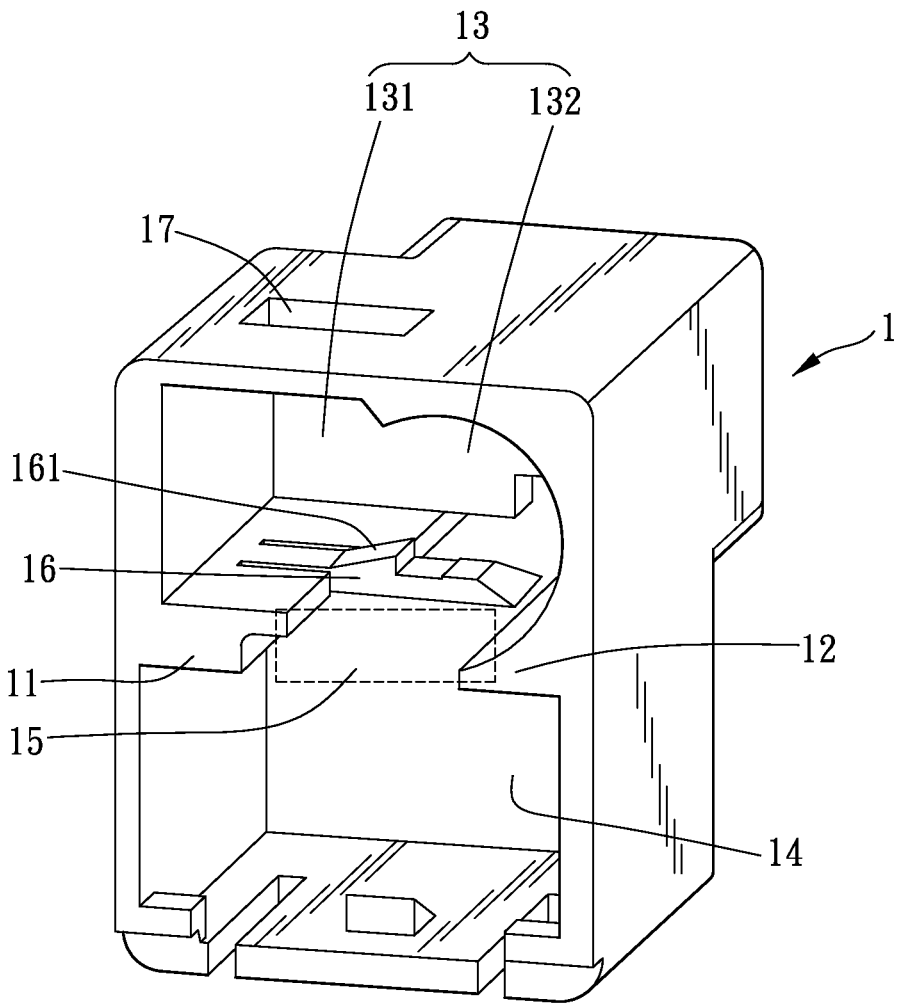
FIG. 2 is a stereogram showing a body of a lock structure of plug of cable of the present invention.
Figure 3:
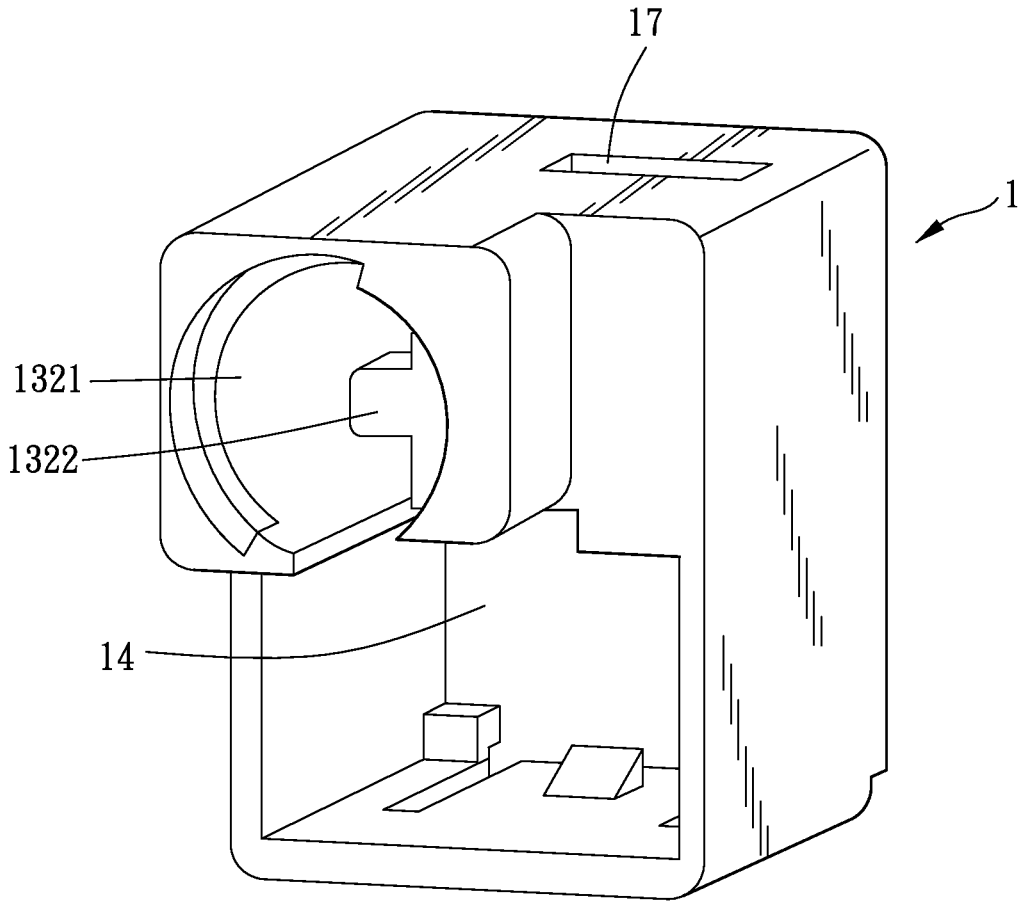
FIG. 3 is a stereogram showing a body of a lock structure of plug of cable of the present invention from another angle.

Please refer to FIG. 1 and FIG. 3, the lock structure of plug of cable of the present invention includes a body 1, an elastic element 2, and a key 3.

The body 1 has a first partition 11 an a second partition 12 to partition an inner space of the body 1 to an upper room 13 and a lower room 14, wherein the upper room 13 includes an elastic area 131 and a locking area 132. The first partition 11 is located under the elastic area 131. The first and the second partitions 11, 12 extend from two opposite walls of the elastic and the locking areas 131,132 respectively, and an interspace 15 is formed between the elastic and the locking areas 131, 132. The first partition 11 has a hook element 16 extending toward the second partition 12 but not touching the second partition 12, the hook element 16 is slightly elastic and is able to wiggle slightly, the hook element 16 has a first protrusion 161 protruding toward the upper room 13. A wall of the elastic area 131 at a side away from the first partition 11 forms a slot 17. A key opening 1321 is formed on a wall of the locking area 132. The key opening 1321 is able to receive the key 3 and enables the key 3 to rotate in the locking area 132. The key 3 and the key opening 1321 have corresponding shapes, so only the key 3 can be inserted into the key opening 1321 and rotate in the locking area 132. In the major embodiment of the present invention, a limitation protrusion 1322 is formed on the key opening 1321, and a corresponding limitation recess 311 is formed on the key 3. Thus, the key 3 can be inserted into the key opening 1321 only at a specific angle, and the key 3 can rotate in the locking area 132 only when the key 3 is inserted into the key opening 1321 in the correct way. Besides, the key 3 can only rotate to a predeterminate maximum angle.

The lower room 14 is used to receive a plug 41 of a cable 4, wherein the plug 41 is inserted into the lower room 14 via a side having the key opening 1321 of the body 1. The plug 41 has a compressible latch 411 received in the interspace 15. When the latch 411 is compressed, the plug 41 is able to be detached from a jack (not shown in drawings). On the contrary, when the latch 411 is not compressed, the plug 41 is unable to be detached from a jack. Besides, a protruding piece is formed on a bottom of the lower room 14 to correspond to a recess under the plug 41 to position the plug 41.

Figure 4:
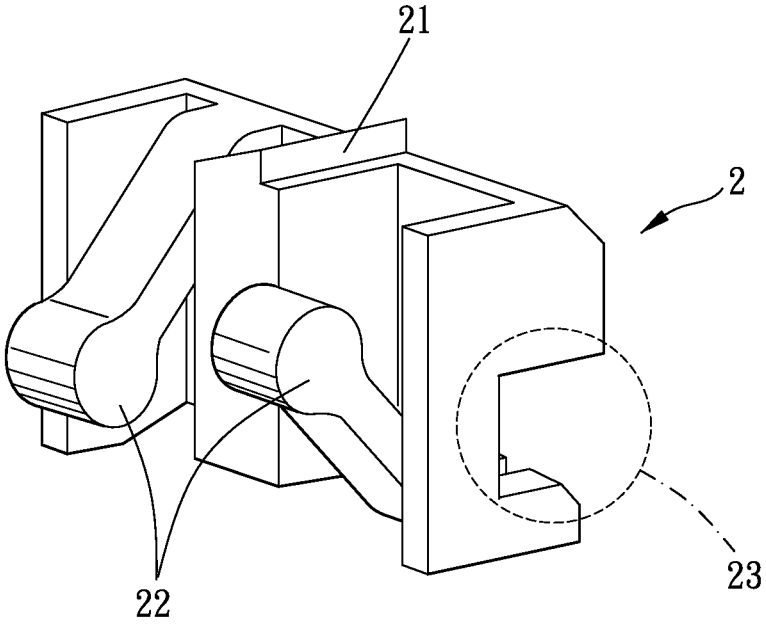
FIG. 4 is a stereogram showing an elastic element of a lock structure of plug of cable of the present invention.
Figure 4A:
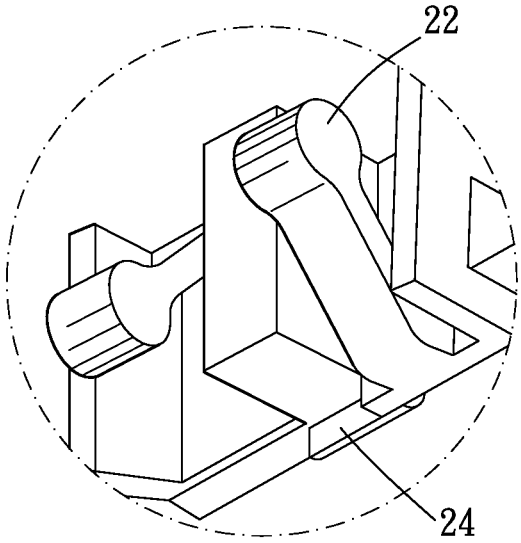
FIG. 4A is a stereogram showing an elastic element of a lock structure of plug of cable of the present invention from another angle.
Figure 4B:
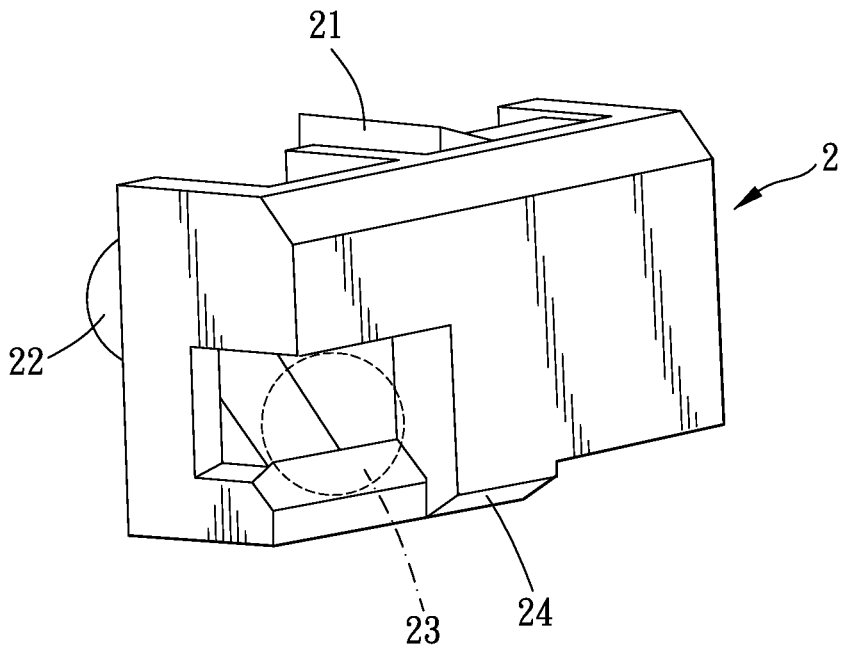
FIG. 4B is a stereogram showing an elastic element of a lock structure of plug of cable of the present invention from another angle.
Figure 5:
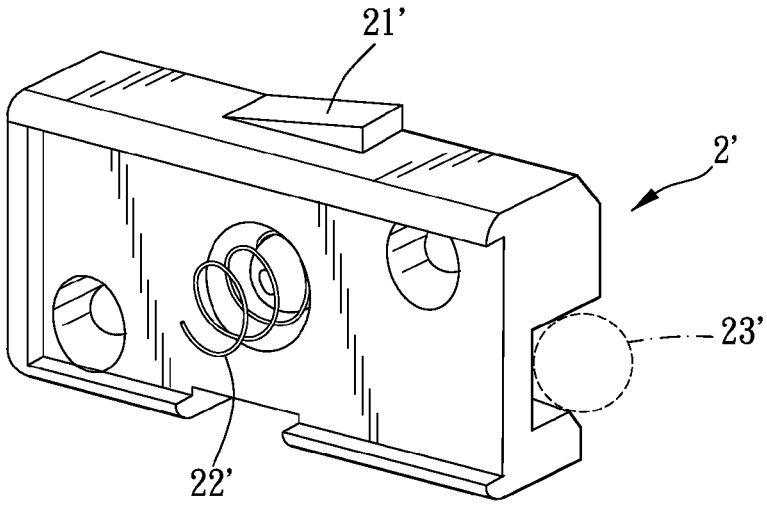
FIG. 5 is a stereogram showing an elastic element in another embodiment of a lock structure of plug of cable of the present invention.
Figure 5A:
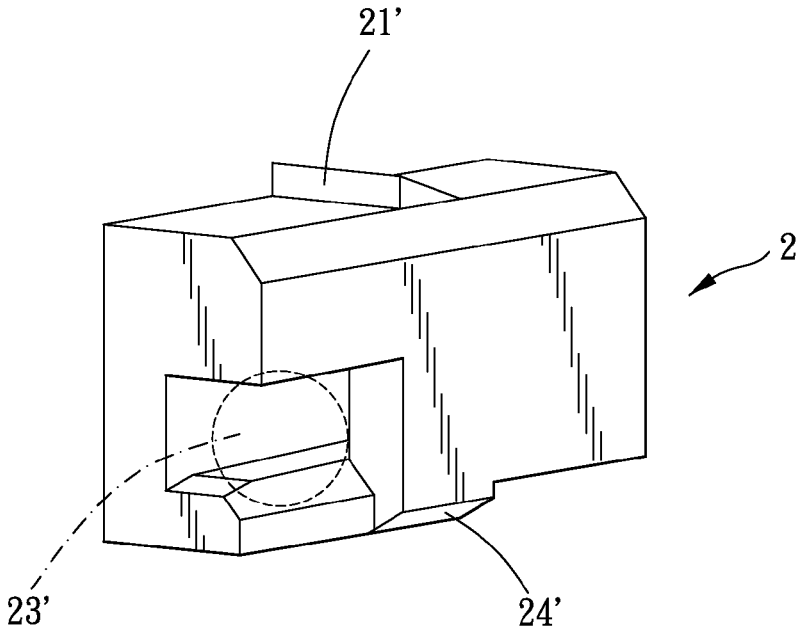
FIG. 5A is a stereogram showing an elastic element in another embodiment of a lock structure of plug of cable of the present invention from another angle.

The elastic element 2 is located in the elastic area 131 and is able to move between a first position and a second position. The elastic element 2 has an elastic structure to enable the elastic element 2 to stay at the first position. In the major embodiment of the present invention, the elastic structure is at least one elastic piece 22, as shown in FIG. 4. The elastic piece 22 is disposed on a side of the elastic element 2 away from the locking area 132 and presses against a wall of the body 1. In another possible embodiment of the present invention, the elastic structure is at least one spring 22', as shown in FIG. 5. The spring 22' is disposed on a side of the elastic element 2' away from the locking area 132 and presses against a wall of the body 1.

Referring to FIG. 2, FIG. 4A, FIG. 4B, and FIG. 5A, a buckle portion 24, 24' is formed on a bottom of the elastic element 2, 2'. When the hook element 16 does not wiggle downward, the first protrusion 161 props against a lower surface of the elastic element 2. More specifically, the first protrusion 161 hooks to the buckle portion 24, 24' of the elastic element to restrict the elastic element 2, 2' at the first position. Please refer to FIG. 2, FIG. 4, FIG. 4B, FIG. 5, and FIG. 5A, the elastic element 2,2' forms a fixing hole 23,23' and a second protrusion 21'21'. A wall of the elastic area 131 away from the first partition 11 forms a slot 17. The second protrusion 21, 21' is located in the slot 17 and is able to move along the slot 17.

Figure 6:
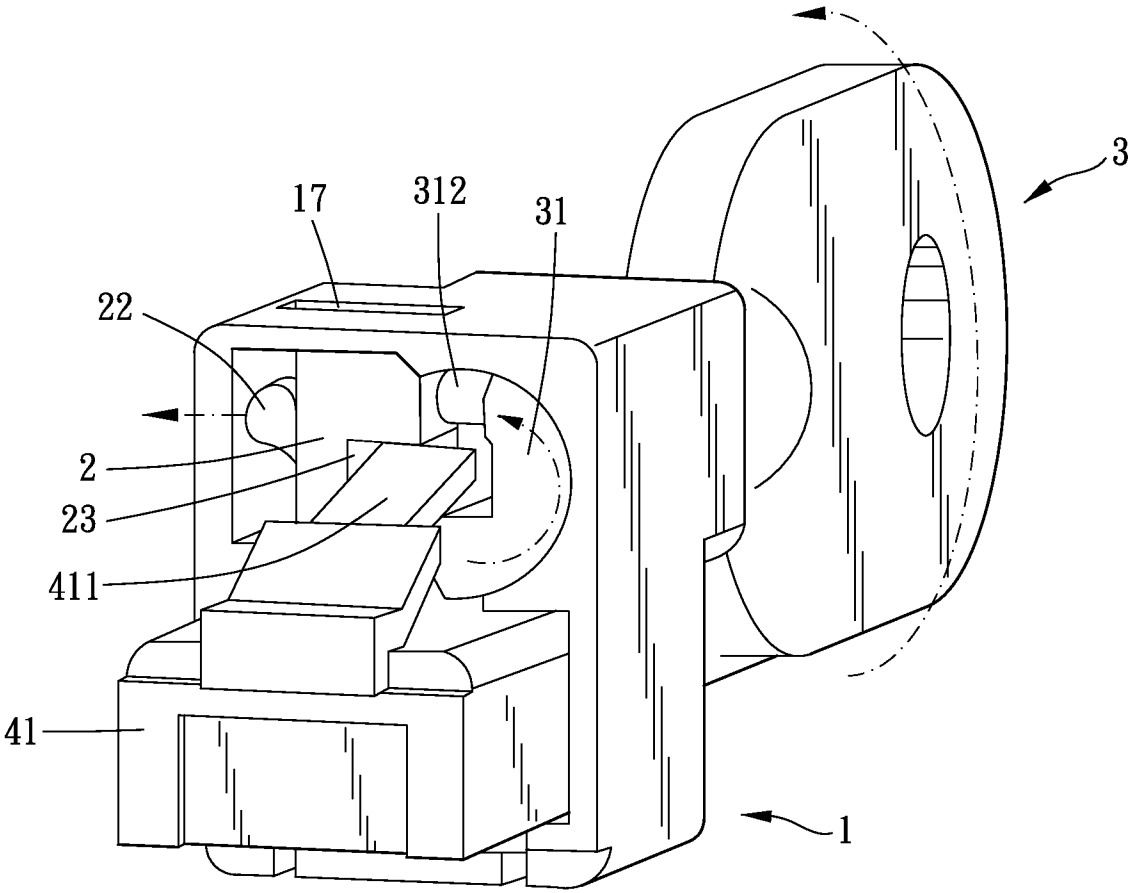
FIG. 6 and FIG. 7 are illustrations of action of a lock structure of plug of cable of the present invention from another angle.
Figure 7:
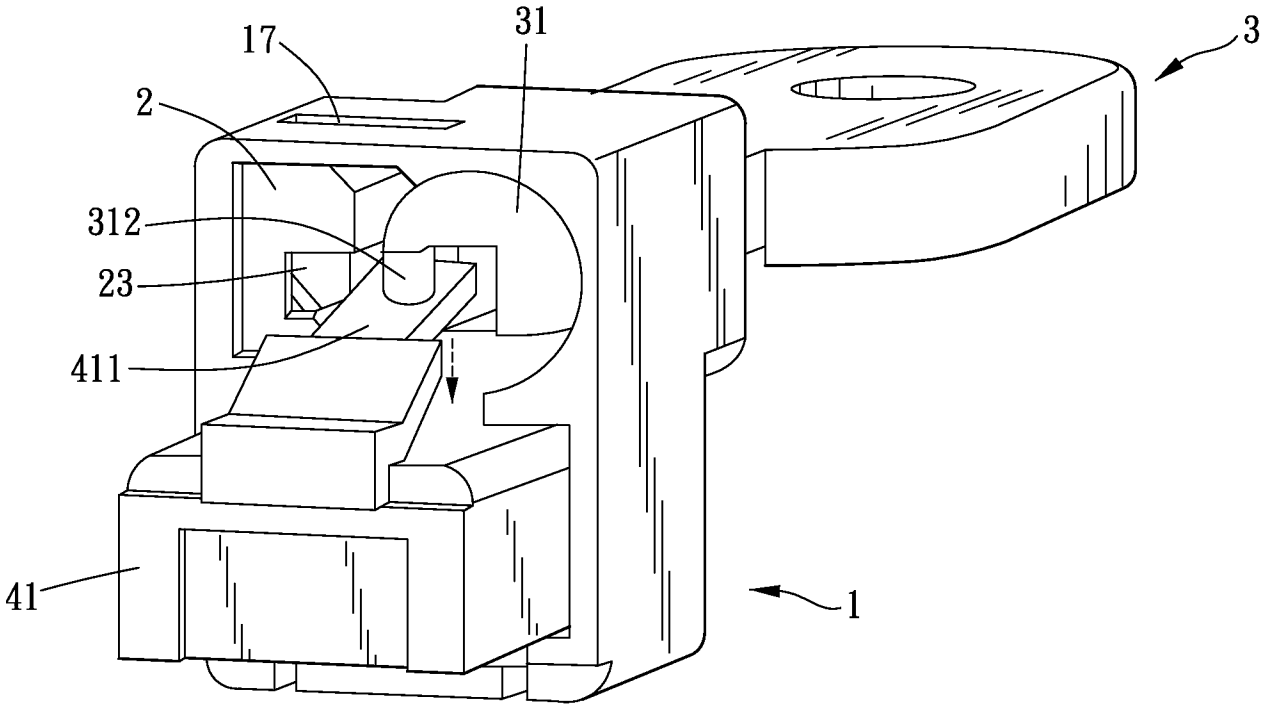

Please refer to FIG. 2, FIG. 3, FIG. 4, FIG. 4A, FIG. 6, and FIG. 7. When the key 3 is not inserted into the key opening 1321 and does not rotate in the locking area 132, or is inserted into the key opening 1321 but not rotate in the locking area 132, as shown in FIG. 6, the buckle portion 24 hooks to the first protrusion 161 and the elastic element stays at the first position. The latch 411 of the plug is locked in the fixing hole 23, so the latch 411 is unable to be compressed. Thus, the plug 41 is unable to be detached from a jack. When the key 3 is inserted into the key opening 1321, the hook element 16 is pressed downward by the key 3. Thus, the first protrusion 161 is separated from the buckle portion 24. When the key 3 rotates in the locking area 132 toward a specific direction, a third protrusion 312 presses the latch 411 downward, and a recess on the third protrusion 312 receives the hook element 16. Besides, the third protrusion 312 pushes the elastic element 2 to the second position. Thus, the latch 411 is compressed, and the plug 41 is able to be detached from a jack.

To conclude, the lock structure of plug of cable of the present invention provides a mechanism to control the availability of the plug for an authorized user. Also, inserting into the key opening and pressing the latch by other tools are prevented by locking of the elastic element. Thereby, safety of informations is enhanced.

What is claimed is:

1. A lock structure of plug of cable, including:

a main body, having a first partition and a second partition to partition a inner space of the main body to an upper room and a lower room, the upper room including an elastic area and a locking area, the first partition being located under the elastic area, a key opening being formed on a wall of the locking area to receive a key and to enable the key to rotate, the lower room enabling a plug of cable to be received in wherein the plug of cable is inserted into the lower room via a side of the main body having the key opening, the plug of cable having a compressible latch;

an elastic element, being located in the elastic area and being able to move between a first position and a second position, the elastic element tending to stay at the first position, the latch of the plug of cable being unable to be compressed when the elastic element is at the first position, the latch of the plug of cable being able to be compressed when the elastic element is at the second position;

wherein the elastic element is at the first position when the key is not inserted into the key opening and does not rotate, the elastic element is pushed to the second position by the key and the latch is compressed by the key when the key is inserted into the key opening and rotates toward a specific direction.

2. The lock structure of plug of cable of claim 1, also including the key, the key and the key opening having corresponding shape, only the key being able to be inserted into the key opening and to rotate.

3. The lock structure of plug of cable of claim 1, wherein the first and the second partitions extend from two opposite walls of the elastic and the locking areas respectively, an interspace is formed between the first and the second partitions and enables the latch of the plug of cable to be received in.

4. The lock structure of plug of cable of claim 1, wherein the first partition has a hook element extending toward the second partition but not touching the second partition, the hook element is slightly elastic and is able to wiggle, the hook element has a first protrusion protruding toward the upper room, the first protrusion props against a lower surface of the elastic element, the first protrusion hooks to a buckle portion of the elastic element to restrict the elastic element at the first position when the hook element does not wiggle downward.

5. The lock structure of plug of cable of claim 1, wherein the elastic element forms a fixing hole to lock the latch of the plug of the cable to unenable the latch to be compressed.

6. The lock structure of plug of cable of claim 1, wherein a wall of the elastic area at a side away from the first partition forms a slot, the elastic element has a second protrusion located in the slot and is able to move along the slot.

7. The lock structure of plug of cable of claim 1, wherein the elastic element including at least one elastic piece disposed on an end of the elastic element away from the locking area.

8. The lock structure of plug of cable of claim 1, wherein the elastic element including at least one spring disposed on an end of the elastic element away from the locking area.

* * * * *